US006655307B2

(12) United States Patent
Gokan

(10) Patent No.: US 6,655,307 B2
(45) Date of Patent: Dec. 2, 2003

(54) PERSONAL WATERCRAFT ON WHICH SUPERCHARGER IS MOUNTED

(75) Inventor: Yoshitsugu Gokan, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/191,443

(22) Filed: Jul. 10, 2002

(65) Prior Publication Data

US 2003/0015126 A1 Jan. 23, 2003

(30) Foreign Application Priority Data

Jul. 17, 2001 (JP) ..... 2001-216518

(51) Int. Cl.[7] ..... B63B 35/73

(52) U.S. Cl. ..... 114/55.5; 440/3; 440/38; 123/559.1

(58) Field of Search ..... 114/55.5; 440/3, 440/38

(56) References Cited

U.S. PATENT DOCUMENTS 6,352,068 B1 * 3/2002 Jacobsen ..... 123/585

6,568,376 B2 * 5/2003 Sonnleitner et al. ..... 123/559.1

FOREIGN PATENT DOCUMENTS

JP 2001-146197 A 5/2001

* cited by examiner

*Primary Examiner*—Jesus D. Sotelo
(74) *Attorney, Agent, or Firm*—Birch, Stewart, Kolasch & Birch, LLP

(57) ABSTRACT

A personal watercraft with an engine and a supercharger, in which a speedy, positive operation of the supercharger is ensured. The system includes an engine for driving a jet propelling pump provided in a watercraft body formed by a hull and a deck in such a manner as to extend in a length direction of the watercraft body. An oil pump is provided on the front side of the engine and a supercharger 140 is provided on the rear side of the engine. The supercharger and an end portion of a main gallery communicate with each other via an oil supply pipe. Oil supplied to the supercharger is used for lubricating a bearing portion of the supercharger. Further, the oil is supplied to an oil jacket formed in a bearing casing of the supercharger to cool the bearing casing. A one-way valve is interposed in an oil return pipe which communicates to an oil outlet of the supercharger.

20 Claims, 14 Drawing Sheets

FIG. 9 (continued)

90: oil cooler

100: oil filter (cartridge)

130: relief valve

80: oil pump (feed)

54c: screen oil filter

50: oil tank

80: oil pump (scavenging)

114R: balancer journal (R)

20a: main gallery

114L: balancer journal (L)

A: oil pressure SW2 (high pressure)

B: oil pressure SW1 (low pressure)

C: cam journal

D: lifter

E: main journal

F: piston back side jetting nozzle

G: connecting rod

H: cam chain

I: starter needle

J: turbine bearing (cooling)

K: turbine bearing (lubrication)

L: Strainer screen (pan)

PERSONAL WATERCRAFT ON WHICH SUPERCHARGER IS MOUNTED

CROSS-REFERENCE TO RELATED APPLICATIONS

The present application claims priority under 35 U.S.C. §119 to Japanese Patent Application No. 2001-216518, filed on Jul. 17, 2001, the entire contents of which are hereby incorporated by reference.

BACKGROUND OF THE INVENTION

1. Field of the Invention

The present invention relates to a personal watercraft on which an engine with a supercharger is mounted, and particularly to an oil supply passage through which oil is supplied to the supercharger.

2. Description of Background Art

Two-cycle engines have generally been used to power personal watercraft. However, to meet recent requirements to reduce environmental pollution, increasing use has been made of four-cycle engines.

Unfortunately, the output of a four-cycle engine is less than that of a two-cycle engine with the same displacement. To compensate for this insufficient output, consideration has been given to mounting a supercharger on these four-cycle engines. For example, the present applicant has already proposed, in Japanese Patent Laid-Open No. 2001-146197, a personal watercraft on which a four-cycle engine with a supercharger is mounted.

In this personal watercraft, as shown in FIGS. 11 and 12, a four-cycle engine 2 with a supercharger 3 is mounted in a watercraft body 1. The supercharger 3 is disposed on a rear side of the engine 2, and an oil tank 5 is disposed on a front side of the engine 2.

As shown in FIG. 13, an oil pump 4 is provided on a front portion of the engine 2 at a position under the oil tank 5. Oil press-fed from the oil pump 4 is supplied to a main gallery 2*a* of the engine 2 via piping 6*d*, an oil filter 6, and piping 6*e*, and is then supplied from the main gallery 2*a* to respective components of the engine 2.

Oil is also supplied from the main gallery 2*a* to a bearing portion 3*a* of the supercharger 3 via an oil passage 2*d* formed in a lower bearing portion 2*c* of a crankshaft 2*b*, an oil passage 2*f* formed in an upper bearing portion 2*e* of the crankshaft 2*b*, and piping 2*g*.

The oil, which has been used for lubricating the bearing portion 3*a* of the supercharger 3 is recovered, via piping 3*b*, to an oil pan 2*i* provided in a lower portion of the engine 2, and is recovered from piping 6*a* to the oil tank 5 via the oil pump 4.

According to the above-described personal watercraft in which the supercharger 3 is disposed on the rear side of the engine 2 and the oil tank 5 is disposed on the front side of the engine 2, the problem of having the oil stored in oil tank 5 being heated by the supercharger 3 is eliminated.

Another problem occurs however, in the above-described related art personal watercraft. Since oil is supplied from the main gallery 2*a* to the bearing portion 3*a* of the supercharger 3 via the oil passage 2*d* formed in the lower bearing portion 2*c* of the crankshaft 2*b*, the oil passage 2*f* formed in the upper bearing portion 2*e* of the crankshaft 2*b*, and the piping 2*g*, it takes more time than is desirable for oil to be supplied to the supercharger 3 after starting the engine 2.

As a result, it is difficult to ensure a speedy, positive operation of the supercharger.

SUMMARY AND OBJECTS OF THE INVENTION

An object of the present invention is to solve the above-described problem and to provide a personal watercraft on which an engine with a supercharger is mounted, which is capable of ensuring a speedy, positive operation of the supercharger.

To achieve the above object, the present invention provides a personal watercraft on which an engine with a supercharger is mounted, having an engine for driving a jet propelling pump is provided in a watercraft body formed by a hull and a deck in such a manner as to extend in a length direction of the watercraft body, a supercharger is provided in a longitudinal direction of the engine; and an oil supply passage for communicating between the supercharger and an end portion of a main gallery of oil provided in parallel to a crankshaft of the engine.

Further, the present invention provides an oil pump on a portion, on a front side of the watercraft body, of the engine and the supercharger is provided on a portion, on a rear side of the watercraft body, of the engine; and the supercharger and a rear end portion of the main gallery are communicated to each other via the oil supply passage.

In addition, in the present invention, the oil supplied to the supercharger is used for lubricating a bearing portion of the supercharger, and the oil is supplied to an oil jacket formed in a bearing casing to cool the bearing casing. An oil outlet in the supercharger is disposed at a position higher than an oil level at the time of stoppage of the engine.

Moreover, the engine of the present invention is a dry sump engine, an oil tank is provided on an extension of a crankshaft of the engine, and a one-way valve is interposed in an oil return passage communicated to the oil outlet in the supercharger.

The present invention as described above provides the following functions and effects.

As mentioned, the engine for driving the jet propelling pump is provided in the watercraft body formed by the hull and the deck in such a manner as to extend in a length direction of the watercraft body, and the supercharger is provided in a longitudinal direction of the engine; and the supercharger and an end portion of the main gallery of oil provided in parallel to the crankshaft of the engine communicate with each other via the oil supply passage. As a result, oil is supplied from the end portion of the main gallery to the supercharger directly via the oil supply passage. Accordingly, the time required to supply oil to the supercharger after start of the engine is shortened, and hence, a speedy, positive operation of the supercharger can be ensured.

In the related art, one end portion of the main gallery must be closed by a plug (see reference numeral 2*p* in FIG. 13). By contrast, with configuration of the engine and supercharger used in the present invention, it is possible to eliminate the need for such a plug.

The oil pump of the present invention is provided on a portion, on the front side of the watercraft body, of the engine, and the supercharger is provided on a portion, on the rear side of the watercraft body, of the engine. Further, the supercharger and a rear end portion of the main gallery communicate with each other via the oil supply passage. As a result, it is possible to readily supply oil to the supercharger disposed on the rear side of the engine.

With the configuration of the present invention, oil supplied to the supercharger is used for lubricating the bearing portion of the supercharger, and also the oil is supplied to the oil jacket formed in the bearing casing to cool the bearing casing. As a result, it is possible to use the oil supplied to the supercharger not only for lubricating the bearing portion of the supercharger, but also for cooling the bearing casing.

In the case of lubricating the bearing portion of the supercharger and cooling the bearing casing by using the oil supplied to the supercharger, to readily supply a large amount of oil is required, as compared with the related art personal watercraft.

However, according to the personal watercraft of the present invention, since oil is supplied from the end portion of the main gallery to the supercharger directly via the oil supply passage, a large amount of oil can be readily supplied to the supercharger Further, with in the present invention, the oil outlet in the supercharger is disposed at a position higher than an oil level at the time of stoppage of the engine. As a result, when the operation of the engine is stopped, oil in the supercharger is readily discharged via the oil outlet.

If oil remains in the supercharger at a high temperature immediately after the engine is stopped, the remaining oil is likely to be carbonized. If this occurs, the entire oil circulating in the engine is likely to deteriorate. The present invention, however, solves this problem, by providing a means by which oil in the supercharger is readily discharged via the oil outlet when the engine is stopped. Accordingly, the amount of oil remaining in the supercharger after the engine is stopped is made as small as possible, thus reducing the deterioration of the entire oil circulating in the engine.

As described earlier, the engine of the present invention is a dry sump engine, and the oil tank is provided on an extension of the crankshaft of the engine. As a result, it is possible to lower an oil level at the time of stoppage of the engine. This, in turn, makes it possible to more readily discharge oil remaining in the supercharger from the oil outlet, and hence to more effectively reduce the deterioration of the entire oil circulating in the engine.

Further, a one-way valve is interposed in the oil return passage communicating with the oil outlet in the supercharger. As a result, it is possible to eliminate the problem that when the personal watercraft is turned over, oil counter flows and remains in the supercharger which still has a high temperature.

This feature helps further to prevent carbonization of oil, and hence to more certainly reduce the deterioration of the entire oil circulating in the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment of the present invention will be described with reference to the drawings.

Figure 1:
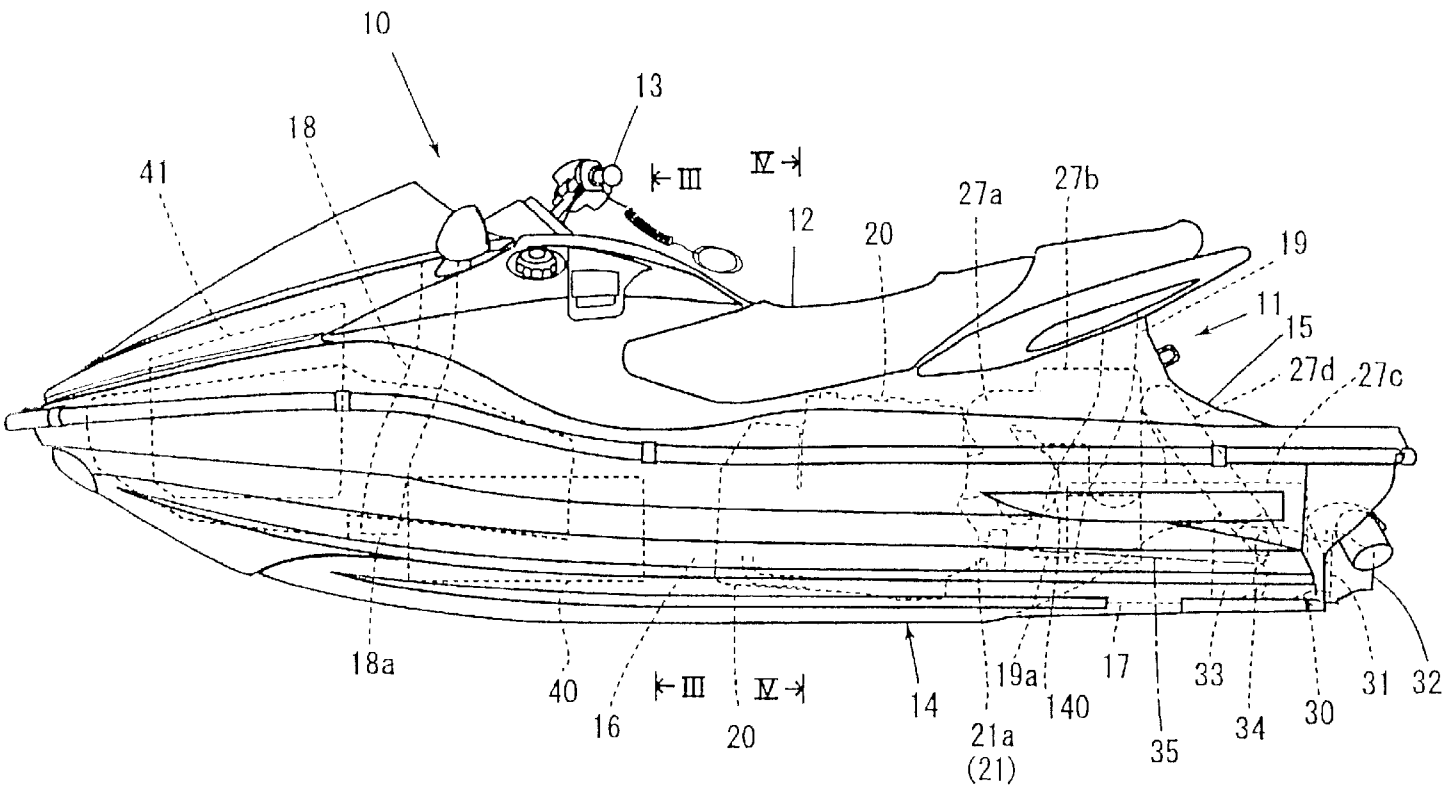
FIG. 1 is a schematic side view showing one example of a personal watercraft on which an engine with a supercharger is mounted according to the present invention.
Figure 2:
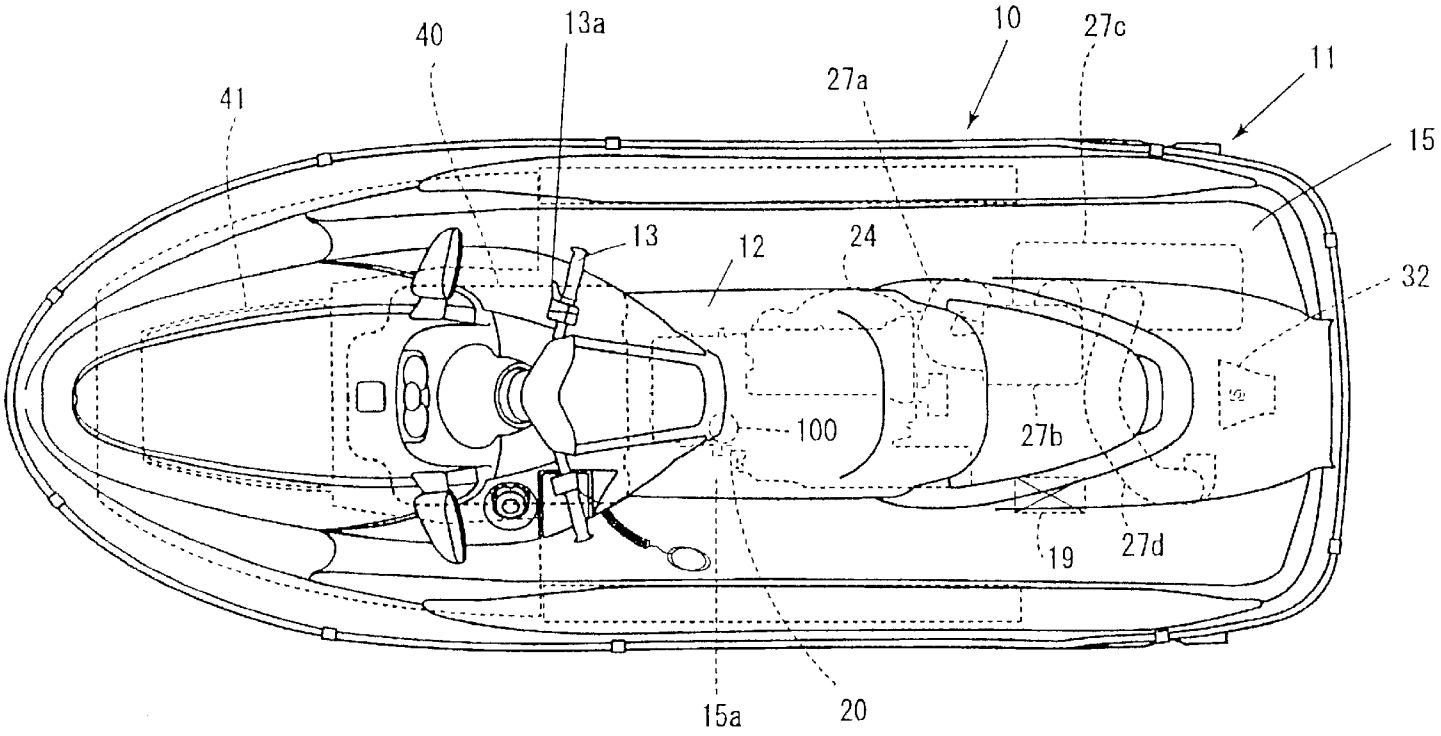
FIG. 2 is a plan view of the personal watercraft shown in FIG. 1.
Figure 3:
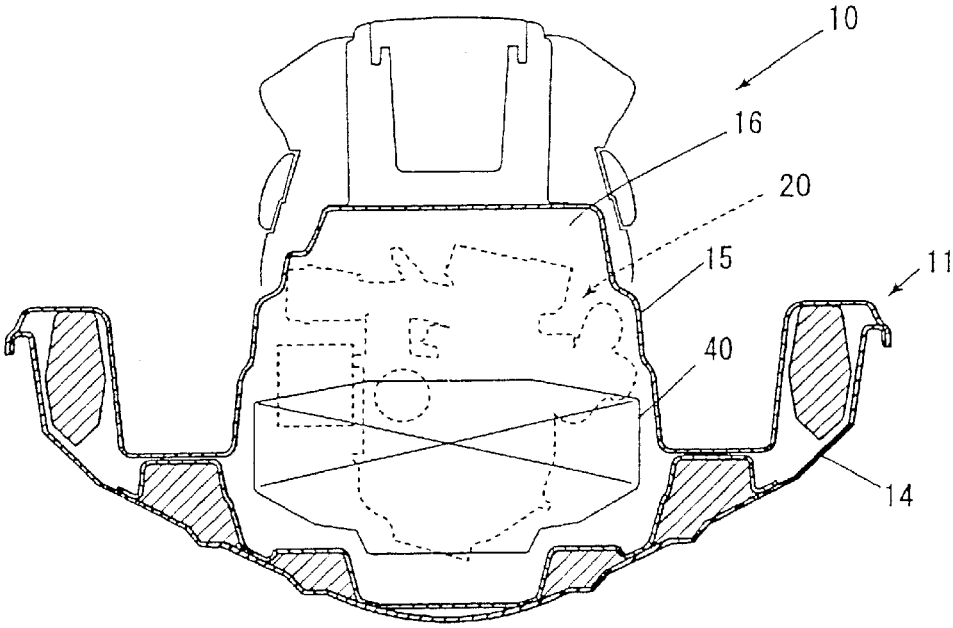
FIG. 3 is a partial, enlarged sectional view taken on line III—III of FIG. 1 (with parts partially omitted)

FIG. 1 is a schematic side view showing one embodiment of a personal watercraft on which an engine with a supercharger according to the present invention is mounted; FIG. 2 is a plan view of the personal watercraft; and FIG. 3 is a partial, enlarged sectional view taken on line III—III of FIG. 1 (with parts partially omitted).

Referring to these figures (particularly, to FIG. 1), a personal watercraft 10 is a saddle-type small watercraft, which is operable by a driver sitting on a seat 12 provided on a watercraft body 11 and holding a steering handlebar 13 provided with a throttle lever.

The watercraft body 11 has a floating structure that a hull 14 is joined to a deck 15 so as to form a space 16 therein. In the space 16, an engine 20 is mounted on the hull 14, and a jet pump or jet propelling pump 30 functioning as propelling means to be driven by the engine 20 is provided on a rear portion of the hull 14.

The jet pump 30 has a flow passage 33 extending from a water inlet 17 opened in a bottom of the hull 14 to both a jet port 31 opened in a rear end portion of the hull 14 and a nozzle 32, and an impeller 34 disposed in the flow passage 33. A shaft 35 of the impeller 34 is connected to an output shaft 21*a* of the engine 20. When the impeller 34 is rotated by the engine 20, water taken in via the water inlet 17 is jetted from the jet port 31 via the nozzle 32, to propel the watercraft body 11 in a forward direction.

A rotational speed of the engine 20, that is, a propelling force of the jet pump 30 is controlled by a turning operation of a throttle lever 13*a* (see FIG. 2) of the steering handlebar 13. The nozzle 32 is coupled to the steering handlebar 13 via a steering wire (not shown), and is turned by operation of the steering handlebar 13, to change a running course. The figures also show a fuel tank 40 and a storing chamber 41.

Figure 4:
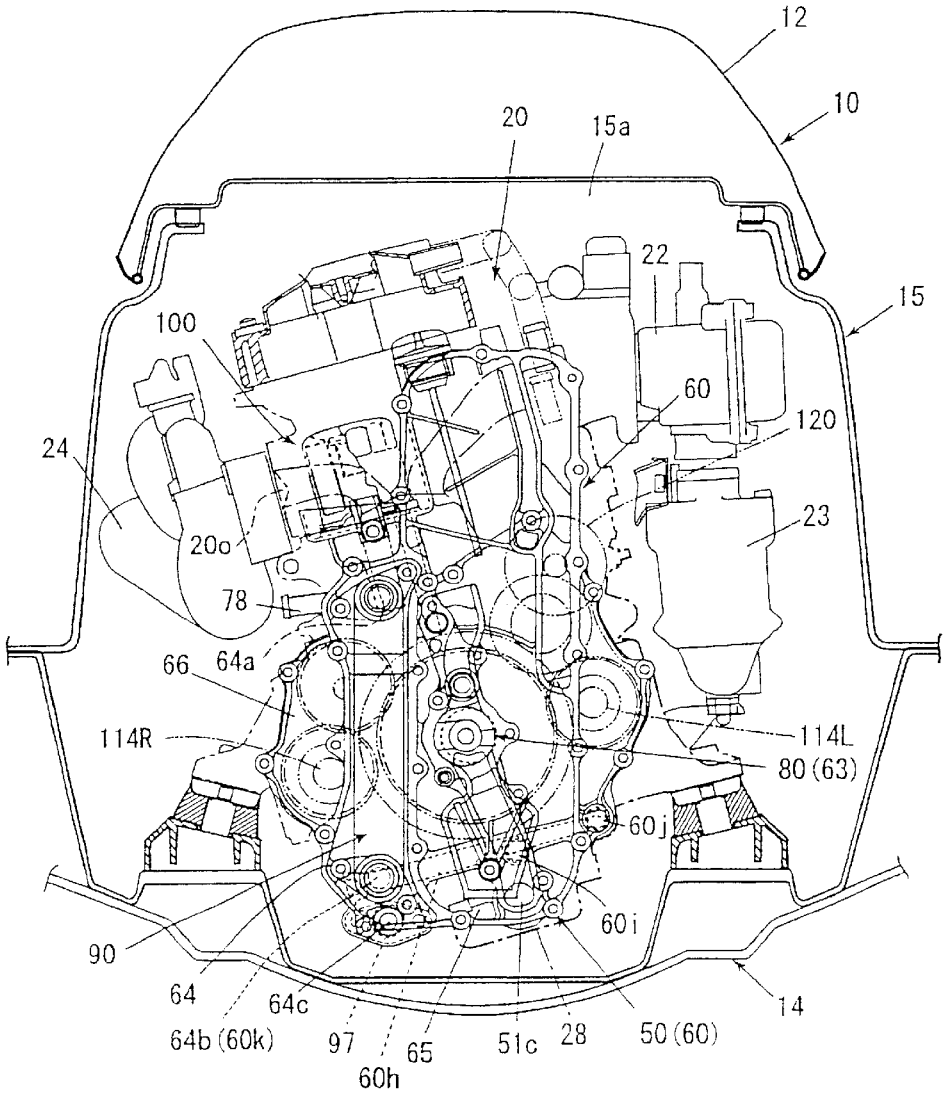
FIG. 4 is a partial, enlarged sectional view taken on line IV—IV of FIG. 1, mainly showing the engine 20.
Figure 5:
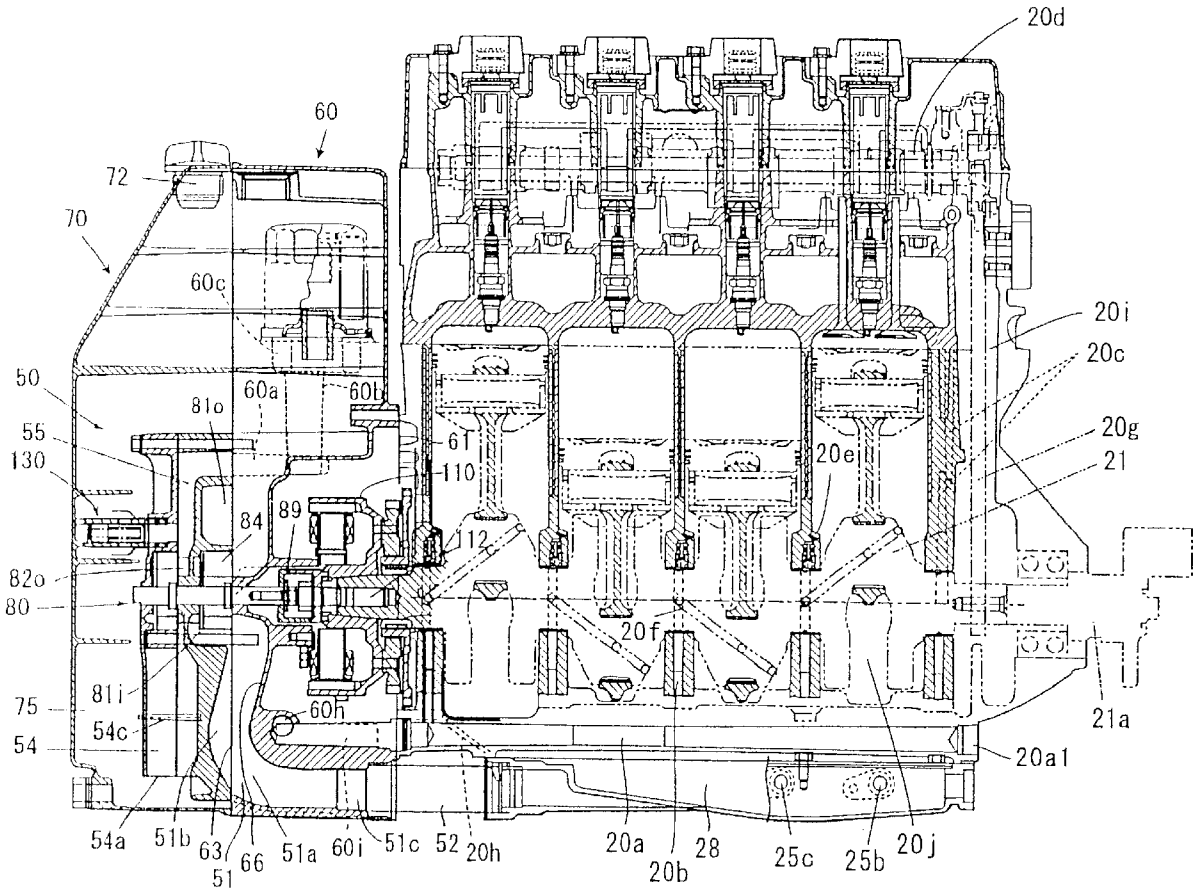
FIG. 5 is a right side view of the engine 20.
Figure 6:
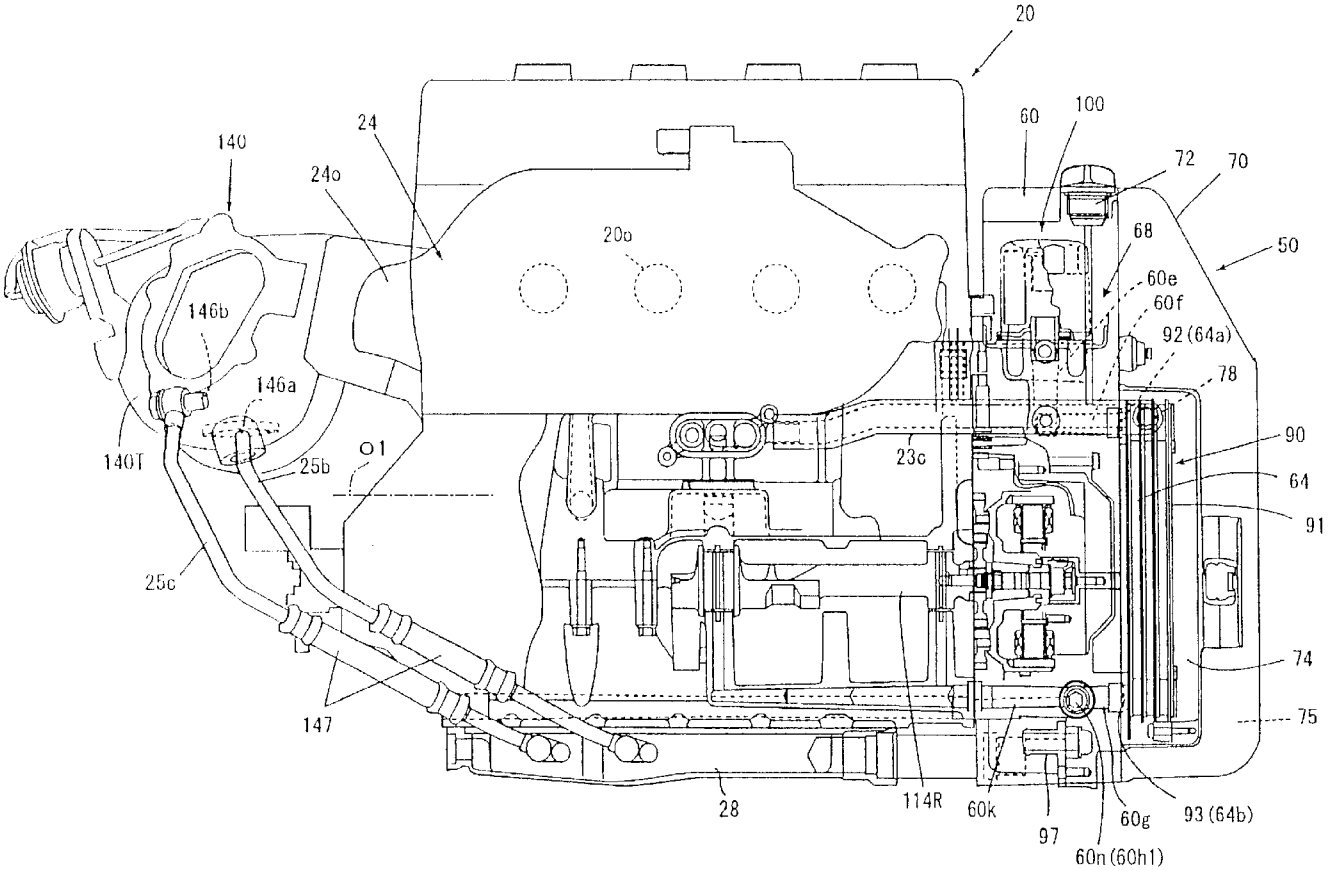
FIG. 6 is a left side view of the engine 20.
Figure 7:
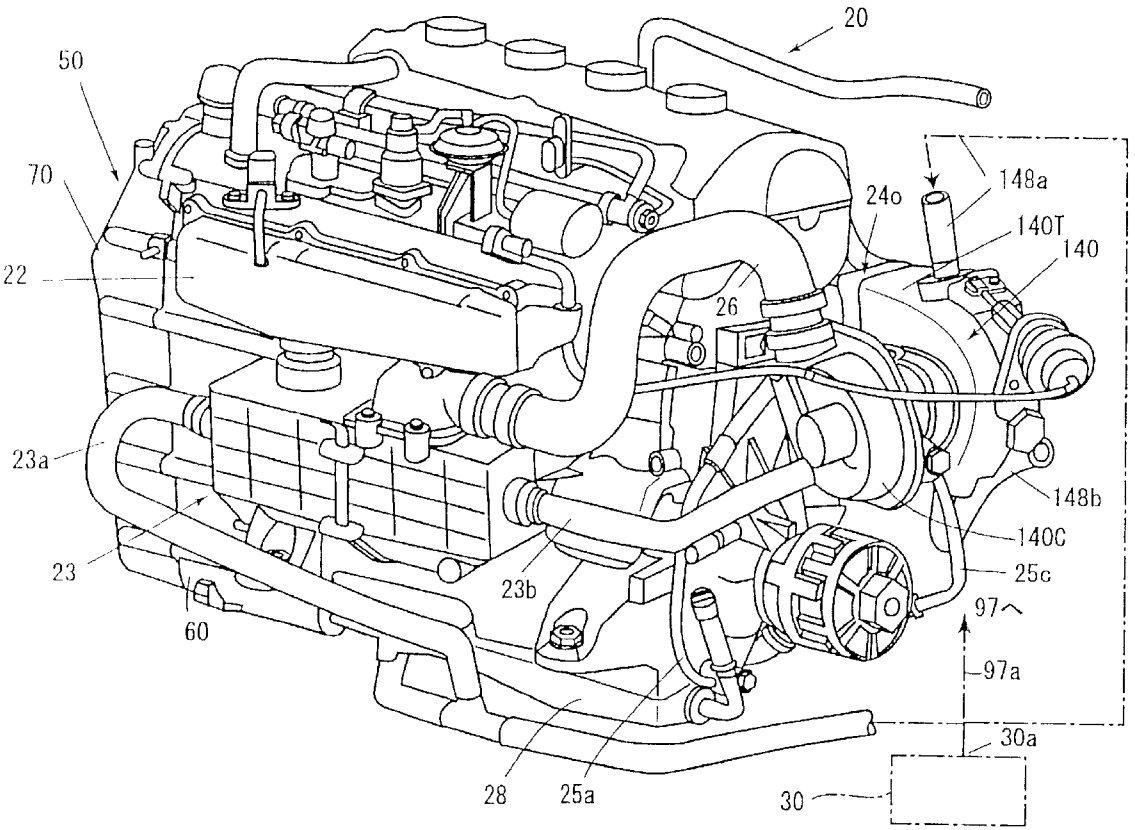
FIG. 7 is a schematic perspective view of the engine 20 as seen from an obliquely rear direction.
Figure 8:
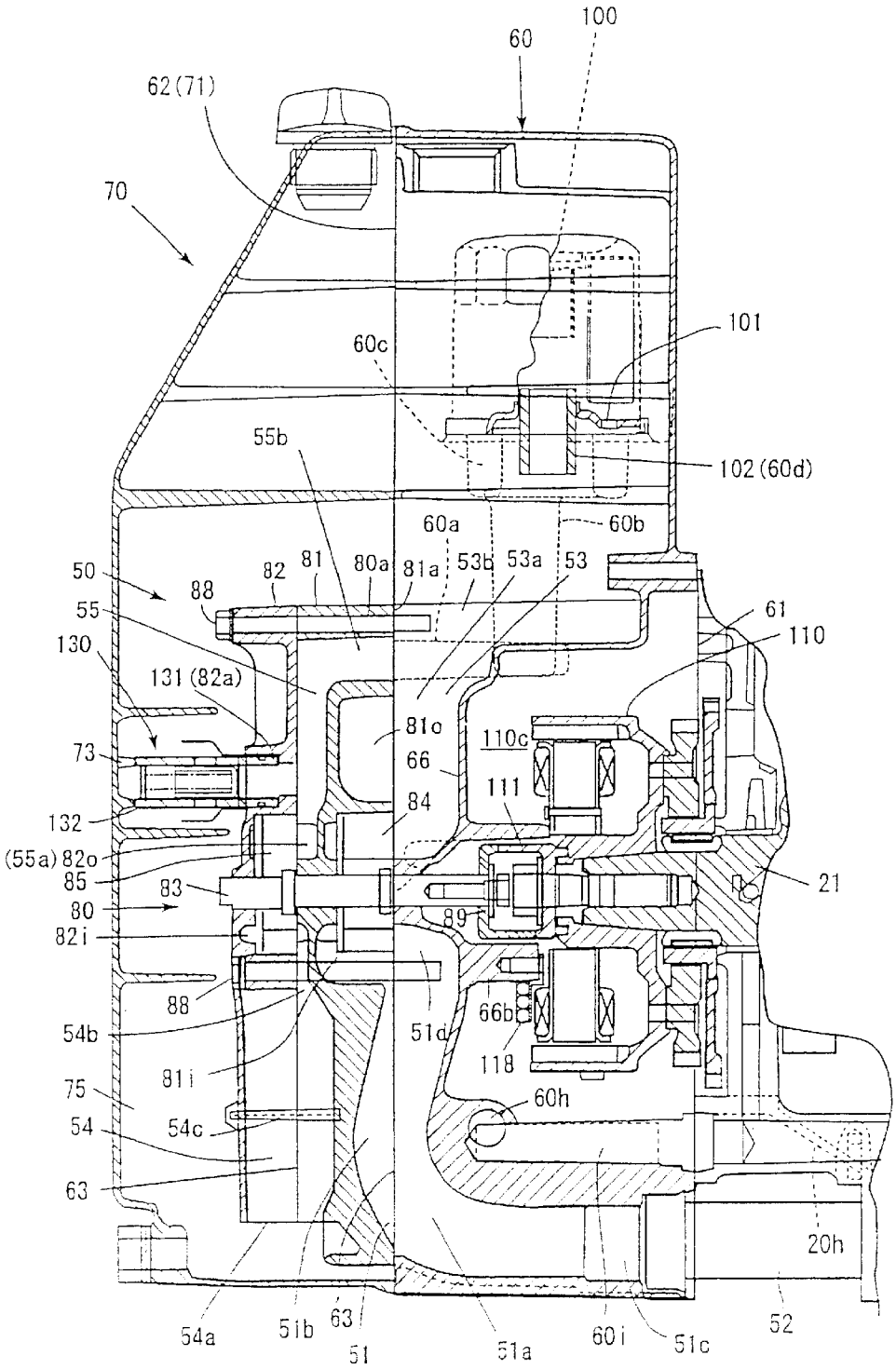
FIG. 8 is an enlarged view of a portion shown in FIG. 5.

FIG. 4 is a view mainly showing the engine 20, which is a partial, enlarged sectional view taken on line IV—IV of FIG. 1 (with parts partially omitted); FIG. 5 is a right side view of the engine 20; FIG. 6 is a left side view of the engine; FIG. 7 is a schematic perspective view of the engine 20 as seen from an obliquely rearward direction, and FIG. 8 is an enlarged view of a portion shown in FIG. 5.

The engine 20 is a DOHC in-line four-cylinder/four-cycle engine, which is particularly of a dry sump according to this embodiment. As shown in FIG. 1, a crankshaft 21 of the engine 20 extends along the longitudinal direction of the watercraft body 11.

As shown in FIGS. 4 and 7, a surge tank (intake chamber) 22 which communicates with an intake port and an intercooler 23 connected to the surge tank 22 are disposed on the left side of the engine 20 as seen in the running direction of the watercraft body 11. An exhaust manifold 24, which is connected to and communicates with exhaust ports 20*o*, is disposed on the right side of the engine 20.

As shown in FIGS. 6 and 7, a turbo-charger (supercharger) 140 is disposed at the back of the engine 20. An exhaust outlet 24*o* of the exhaust manifold 24 is connected to a turbine portion 140T of the turbo-charger 140, and the intercooler 23 is connected to a compressor portion 140C of the turbo-charger 140 via piping 26 (see FIG. 7). FIG. 7 shows cooling hoses 23*a* and 23*b* connected to the intercooler 23.

After being used for rotating a turbine in the turbine portion 140T of the turbo-charger 140, an exhaust gas passes piping 27*a*, an anti-counterflow chamber 27*b* for preventing counterflow upon turn-over of the watercraft body 11, a water muffler 27*c*, and an exhaust/drainage pipe 27*d*, and lastly, flows into the water stream caused by a jet pump 30. This is shown in FIGS. 1 and 2.

FIG. 1 shows intake ducts 18 and 19 for introducing atmospheric air outside the watercraft body 11 in the space 16 inside the watercraft body 11. Lower ends 18*a* and 19*a* of the intake ducts 18 and 19 are provided, in the watercraft body 11, at positions lower than that of the turbo-charger 140. In other words, the turbo-charger 140 is disposed at a position higher than those of the lower ends 18*a* and 19*a* of the intake ducts 18 and 19. The turbo-charger 140 is located, in the space 16 in the watercraft body 11, at an approximately central position in the height direction.

As shown in FIGS. 4 to 7, in a front portion of the engine 20 as seen in the running direction of the watercraft body 11 (equivalent to a left portion in FIGS. 1 and 5), an oil tank 50 and an oil pump 80 integrated with the oil tank 50 are provided on an extension of the crankshaft 21. The oil pump 80 is provided in the oil tank 50.

The oil tank 50 includes a tank main body (one divided case) 60 joined to a front plane of the engine 20, and a cover (the other divided case) 70 joined to a front plane of the tank main body 60.

Referring to FIGS. 4 and 6, in the oil tank 50, a water-cooled oil cooler 90 is provided on a front surface of the tank main body 60 and an oil filter 100 is provided on an upper portion of the oil tank 50.

Referring to FIGS. 4, 5 and 8, the tank main body 60 includes a joint plane 61 joined to the front plane of the engine 20, a joint plane 62 jointed to the cover 70, an oil pump 80 mounted on mounting plane 63, and a water-cooled oil cooler 90 mounted on mounting portion 64. The tank main body 60 further includes an oil storing portion 65 which is defined by partition walls forming the mounting planes and outer walls, and is formed into a vertically-elongated shape as a whole. Also included are a cover portion 66 for covering drive chambers for an ACG 110, balancer shafts 114L and 114R, and a starter motor 120. As shown in FIG. 6, the tank main body 60 also includes a mounting portion 68 on which the oil filter 100 is mounted.

The joint plane 61 of the tank main body 60 is joined to the front plane of the engine 20 in a state that the above-described components are covered with the cover portion 66 of the tank main body 60, and the tank main body 60 is integrally fixed to the front plane of the engine 20 with a bolt (not shown). In addition, the tank main body 60 is mounted to the front plane of the engine 20 after the oil pump 80 and the oil cooler 90 are mounted to the tank main body 60.

The cover 70 includes a joint plane 71 joined to the tank main body 60, an oil supply port 72, a pressing portion 73 for pressing a relief valve 130, and an accommodating portion 74 for accommodating the oil cooler 90 (see FIG. 6), and an oil storing portion 75 defined by the outer walls and partition walls.

The oil pump 80 includes a first case 81 joined to the tank main body 60, a second case 82 jointed to the first case 81, a pump shaft 83 provided so as to pass through the first and second cases 81 and 82, an oil recovering inner/outer rotor 84 connected to the pump shaft 83 in the first case 81, and an oil supplying inner/outer rotor 85 connected to the pump shaft 83 in the second case 82.

The oil recovering inner/outer rotor 84 forms an oil recover pump in cooperation with the first case 81, and the oil supplying inner/outer rotor 85 forms an oil supply pump in cooperation with the first and second cases 81 and 82.

A joint plane, to be joined to the tank main body 60, of the first case 81 is joined to the joint plane 63 which is formed on the front plane of the tank main body 60 and has the same shape as that of the joint plane of the first case 81. The oil pump 80 is mounted to the front plane of the tank main body 60 with a bolt 88.

After the oil pump 80 is mounted to the tank main body 60, a coupling 89 is fixed, from the back surface side of the tank main body 60, to a rear end of the pump shaft 83 with a bolt.

After the oil pump 80 and its coupling 89 are mounted to the tank main body 60, the oil cooler 90 is mounted to the tank main body 60, and then the tank main body 60 is mounted to the front plane of the engine 20 in such a manner that the coupling 89 is coupled to a coupling 111 provided at the leading end of the ACG shaft.

The water-cooled oil cooler 90 is mounted to the front surface side of the oil cooler 90 mounting portion 64 of the tank main body 60.

Referring to FIGS. 4 and 6, the mounting portion 64 of the tank main body 60 has an upper hole 64*a* and a lower hole 64*b* communicating with an oil passage to be described later.

On the other hand, the oil cooler 90 has a plurality of heat exchange plates 91 allowing oil to pass therethrough, an oil inlet pipe 92 communicating with the insides of upper portions of the plates 91, and an oil outlet pipe 93 communicating with the insides of lower portions of the plates 91.

The oil cooler 90 is mounted to the mounting portion 64 of the tank main body 60 in such a manner that the inlet pipe 92 is connected to the upper hole 64*a* of the tank main body 60 and the outlet pipe 93 is connected to the lower hole 64*b* of the tank main body 60.

Referring to FIGS. 4 and 6, a cooling water introducing pipe 97 communicating with a hole 64*c* opened in the mounting portion 64 for introducing cooling water in the mounting portion 64 and the oil cooler accommodating portion 74 of the cover 70 is provided in the tank main body 60. The cover 70 is provided with a water discharge pipe 78.

A cooling water hose 97*a* from a cooling water takeoff portion 30*a* (see FIG. 7) in the jet pump 30 is connected to the introducing pipe 97 directly, that is, without interposition of any cooling object therebetween, and an drainage pipe 23*c* is, as shown in FIG. 6, connected to the discharge pipe 78. Water from the drainage pipe 78 is supplied to a water jacket of the exhaust manifold 24 via the drainage pipe 23*c*.

As can be seen in FIGS. 5 and 8, the tank main body 60, the oil pump 80, and the oil cooler 90 are must be first mounted on the front plane of the engine 20 as described above. After that, a rear end 131 of a relief valve 130 is then fitted in a hole 82*a* formed in a front plane of the second case 82 of the oil pump 80 and the cover 70 is joined and bolted to a front plane of the tank main body 60 in such a manner that a leading end 132 of the relief valve 130 is pressed by the above-described pressing portion 73. The relief valve 130 is thus horizontally disposed.

In a state that the cover 70 is joined to the tank main body 60, a single oil storing portion is formed by both the oil storing portions 65 and 75. The oil filter 100 is mounted to the oil filter 100 mounting portion 68 of the tank main body 60.

In a state that the engine 20 is mounted on the watercraft body 11, the engine 20 and the oil filter 100 are aligned with an opening 15*a* of the deck 15 as shown in FIGS. 2 and 4. The opening 15*a* of the deck 15 is opened by removing the seat 12 from the watercraft body 11.

In a state that the oil tank 50 (including the tank main body 60, the cover 70, and the oil pump 80, the oil cooler 90 and the relief valve 130 contained in the cover 70) is mounted to the front plane of the engine 20, and the oil filter 100 is mounted to the mounting portion 68 of the tank main body 60, the oil passages discussed below are formed.

Referring to FIGS. 5 and 8, an oil recovery passage 51 is formed between the front plane of the tank main body 60 and the back surface of the first case 81 of the oil pump 80. The recovery passage 51 includes an oil passage 51*a* formed on the tank main body 60 side, and an oil passage 51*b* which is formed in a portion, on the first case 81 side, of the oil pump 80 in such a manner as to be opposed to the oil passage 51*a*.

A lower end 51*c* of the oil recovery passage 51 communicates with an oil pan 28 of the engine 20 via a pipe 52, and an upper end 51*d* of the oil recovery passage 51 communicates with a recovery oil suction port 81*i* formed in a portion, on the first case 81 side, of the oil pump 80.

Similarly, a recovery oil discharge passage 53 between the front plane of the tank main body 60 and the back surface of the first case 81 of the oil pump 80 is formed. The recovery oil discharge passage 53 includes an oil passage 53*a* formed on the tank main body 60 side, and a recovery oil discharge port 81*o* which is formed in a portion, on the first case 81 side, of the oil pump 80 in such a manner as to be opposed to the oil passage 53*a*.

An upper end 53*b* of the recovery oil discharge passage 53 is opened in the oil tank 50 (that is, in the oil storing portions).

On the other hand, a supplied oil suction passage 54 and a supplied oil discharge passage 55 are formed between the front plane of the first case 81 of the oil pump 80 and the back surface of the second case 82 of the oil pump 80.

A lower end 54*a* of the suction passage 54 is opened in the oil tank 50 (that is, in the oil storing portions), and an upper end 54*b* of the suction passage 54 communicates with a supplied oil suction port 82*i* of an oil supply pump. A screen oil filter 54*c* is provided in the suction passage 54.

A lower end 55*a* of the discharge passage 55 communicates with a supplied oil discharge port 82*o* of the oil supply pump. An upper end 55*b* of the discharge passage 55 passes through an upper portion of the first case 81 in the horizontal direction, to communicate with a horizontal hole 60*a* formed in the tank main body 60. The horizontal hole 60*a* communicates with a vertical hole 60*b* formed in the tank main body 60.

An upper end 60*c* of the vertical hole 60*b* is opened in the oil filter 100 mounting portion 68 in such a manner as to be formed into a ring-shape in a plan view. An oil flow-in passage 101 of the oil filter 100 communicates with the upper end 60*c* of the vertical hole 60*b*.

The mounting hole 82*a* of relief valve 130, described above, is opened in the discharge passage 55, and the relief valve 130 is mounted in the mounting hole 82*a*.

A male screw is provided in an oil outlet pipe 102 in the oil filter 100. The oil filter 100 is mounted to the mounting portion 68 of the tank main body 60 by screwing the male screw portion of the oil outlet pipe 102 in a female thread hole 60*d* formed in the mounting portion 68 of the tank main body 60.

As shown in FIG. 6, in the tank main body 60, a vertical hole 60*e* and a horizontal hole 60*f* communicating with a lower end of the vertical hole 60*e* are formed in a lower portion of the female thread hole 60*d*. In addition, the horizontal hole 60*f* communicates with the inlet pipe 92 of the oil cooler 90 via the upper hole 64*a* formed in the oil cooler 90 mounting portion 64.

On the other hand, as shown in FIGS. 4 to 6, the outlet pipe 93 of the oil cooler 90 is connected to the lower hole 64*b* of the tank main body 60. An oil passage 60*g*, communicating with the lower hole 64*b*, and an oil distribution passage 60*h*, communicating with the passage 60*g*, are formed in the lower hole 64*b*. The oil distribution passage 60*h* communicates with three passages: a main gallery oil supply passage 60*i* for supplying oil to a main gallery 20*a* of the engine 20 (see FIG. 5), a left balancer oil supply passage 60*j* for supplying oil to a bearing portion of the left balancer 114L, and a right balancer oil supply passage 60*k* for supplying oil to a bearing portion of the right balancer 114R.

One end of the oil distribution passage 60*h* is closed with a plug 60*n* (see FIG. 6).

Figure 9:
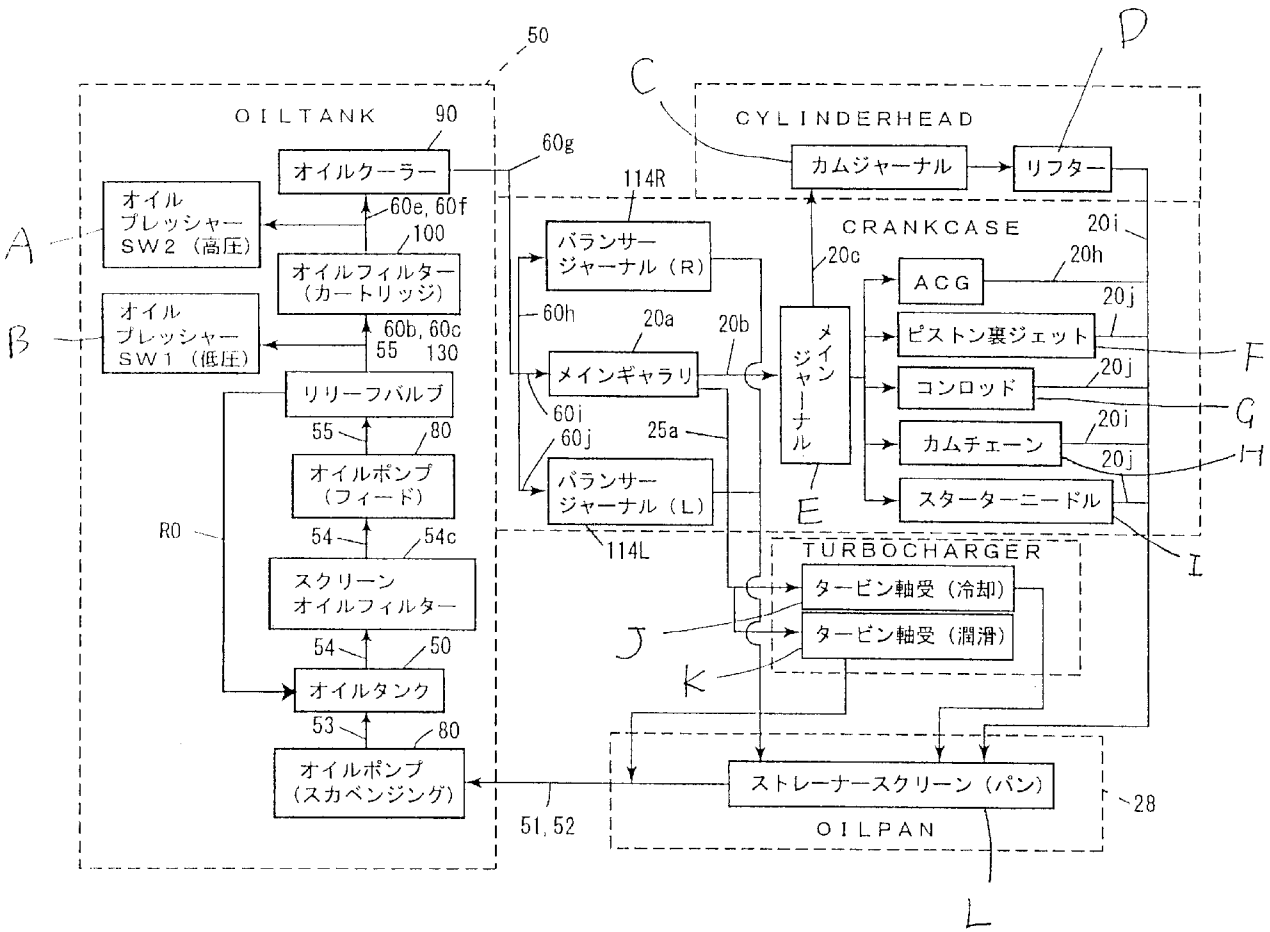
FIG. 9 is a diagram showing an oil circulation route.

A route of oil supplied to the main gallery 20*a* of the engine 20 is as shown in FIG. 9 (which is an oil circulation route diagram).

The route of oil supplied to the main gallery 20*a* is basically classified into two routes.

The first route extends from a route 20*b* (see FIG. 5) to a bearing portion of the crankshaft 21. Oil is supplied to the bearing portion of the crankshaft 21 via such a first route.

The second route extends from a rear end 20*al* of the main gallery 20*a* to a turbine bearing portion of the turbo-charger 140 via a pipe 25*a* (see FIG. 7). Oil is supplied to the turbine bearing portion of the turbo-charger 140 via such a second route for cooling and lubricating the turbine bearing portion. The oil, which has been used for cooling and lubricating the turbine bearing portion of the turbo-charger 140, is recovered to the oil pan 28 via pipes 25*b* and 25*c* (see FIG. 6).

The oil, which has been supplied to the bearing portion of the crankshaft 21, is then supplied to a cam journal 20*d* portion and a lifter portion of a cylinder head via a route 20*c* for lubricating the cam journal 20*d* portion and the lifter portion, and is returned to the oil pan 28 via a chain chamber 20*i*.

The oil, which has been supplied to the bearing portion of the crankshaft 21, is then supplied to the ACG, a piston back side jetting nozzle, a connecting rod, a cam chain, and a starter needle, and is returned to the oil pan 28 via the corresponding recovery passages. FIG. 5 shows a jet nozzle 20*e* for jetting oil to the back side of the piston, a passage 20*f* for communicating with the connecting rod portion, a cam chain 20*g*, and a return passage 20*h* for returning oil from an ACG chamber 110*c*.

The oil, which has been supplied to the ACG chamber 110*c*, is returned to the oil pan 28 via the return passage 20*h*. Used oil to be jetted from the jet nozzle 20*e* to the back side of the piston, oil having been supplied to the connecting rod, and oil having been supplied to the starter needle are each returned to the oil pan 28 via a crank chamber 20*j*.

As is apparent from the above description, referring mainly to FIG. 9, the general flow of oil is as follows:

Oil tank 50→suction passage 54→screen oil filter 54*c*→oil pump (supply pump) 80→discharge passage 55 (and relief valve 130, horizontal hole 60*a*, vertical hole 60*b*, and ring-shaped opening 60*c*)→oil filter 100→vertical hole 60*e* and horizontal hole 60*f*→oil cooler 90→oil passage 60*g* and oil distribution passage 60*h*→main gallery oil supply passage 60*i*, left balancer oil supply passage 60*j* and right balancer oil supply passage 60*k*→main gallery 20*a*, left balancer 114L and right balancer 114R.

The relief oil, denoted by character RO, flowing from the relief valve 130 is directly returned to the inside of the oil tank 50.

The oil, which has been supplied to the left balancer 114L and the right balancer 114R, is returned to the oil pan 28 via the crank chamber 20*j*.

The oil, which has been supplied from the main gallery 20*a* to the above-described respective portions, is returned to the oil pan 28 as described above.

The oil thus returned to the oil pan 28 is the recovered to the oil tank 50 via the pipe 52, the oil recovery passage 51, the oil pump (recovery pump) 80, and the recovery oil discharge passage 53, and is circulated again from the suction passage 54 to the above-described portions by way of the above-described routes.

Figure 10:
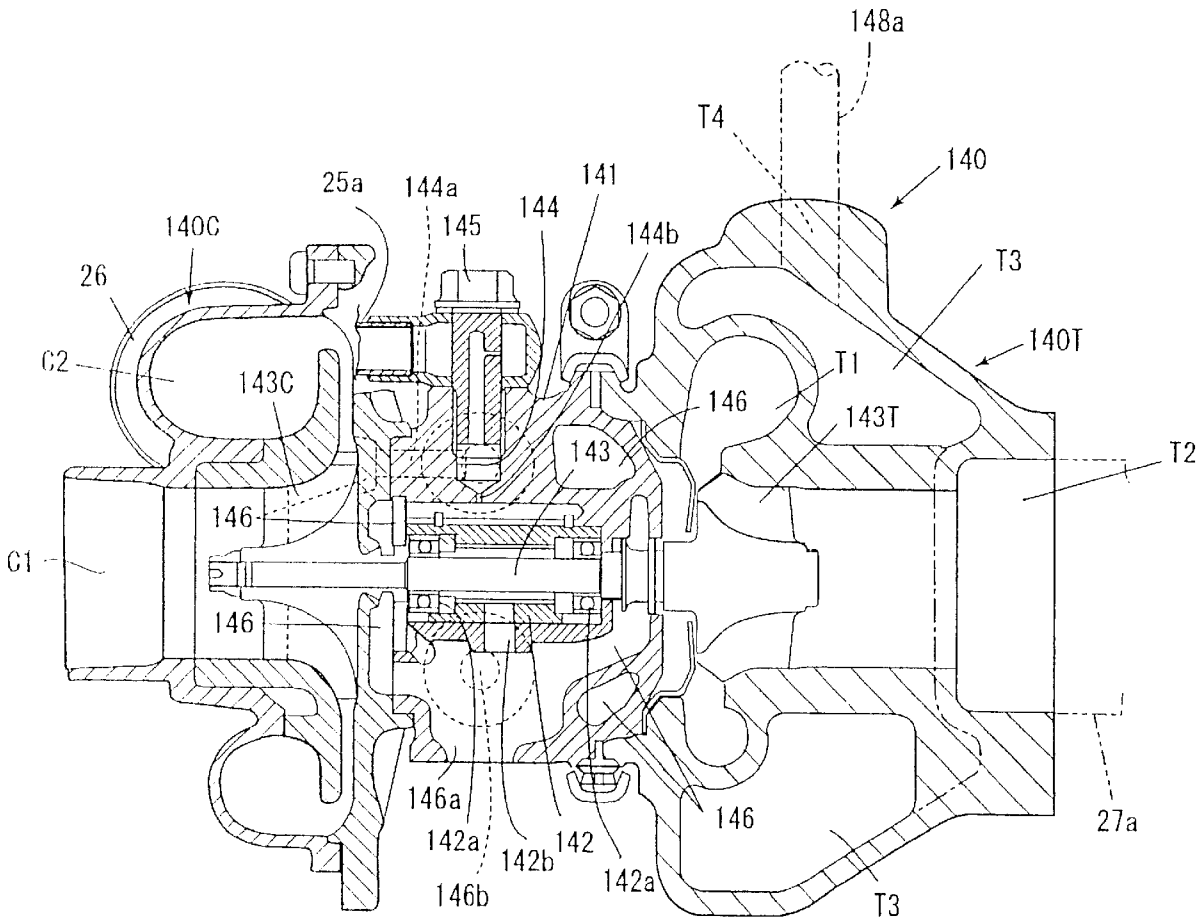
FIG. 10 is a sectional view of a turbo charger 140.
Figure 11:
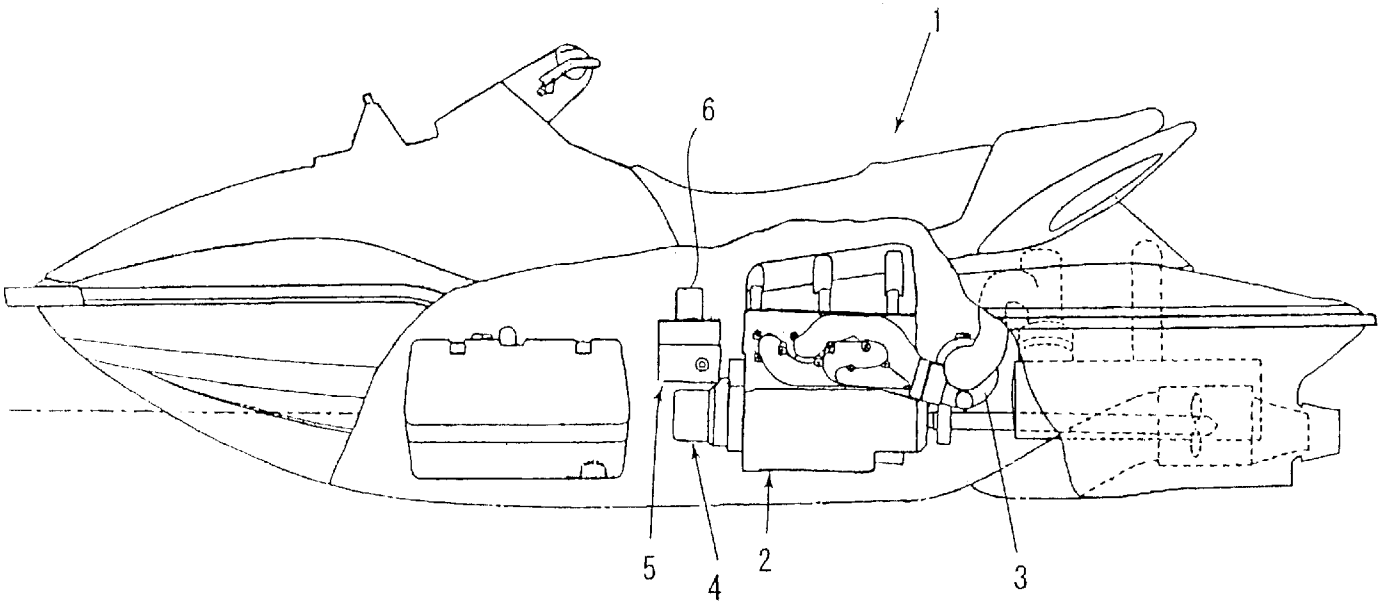
FIG. 11 PRIOR ART
FIG. 11 is a view illustrating a related art personal watercraft.
Figure 12:
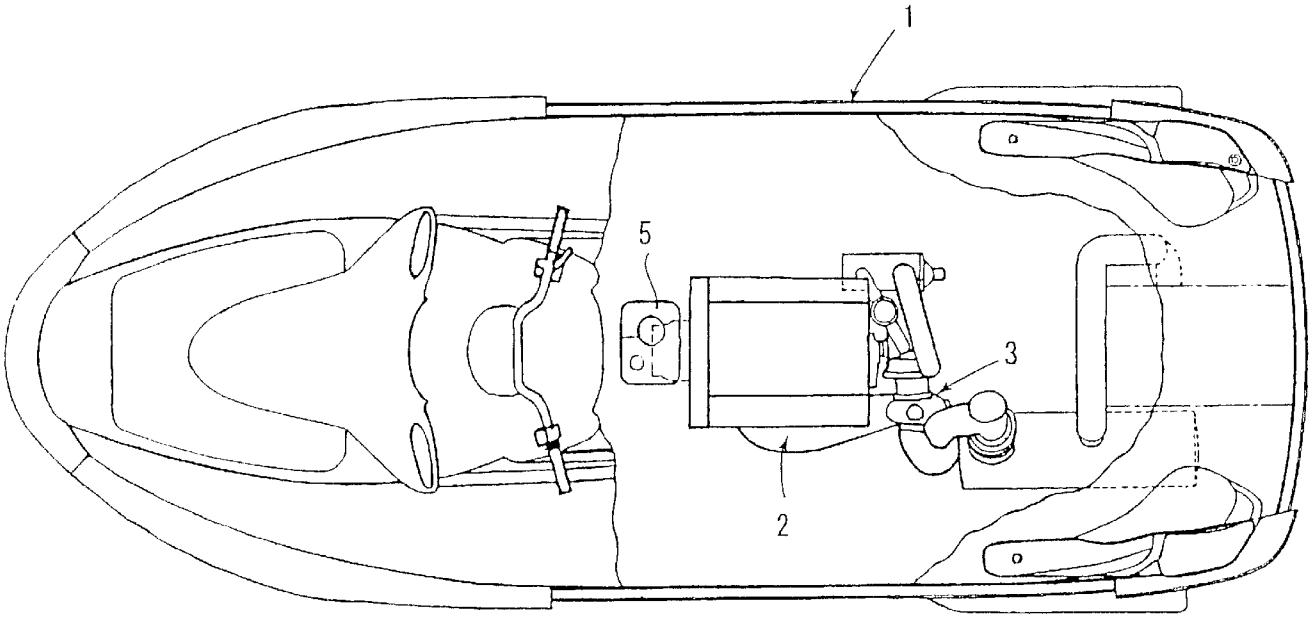
FIG. 12 PRIOR ART
FIG. 12 is a view illustrating the related art personal watercraft shown in FIG. 11.

FIG. 10 is a sectional view showing the turbo-charger 140.

As described above, the turbo-charger 140 includes the turbine portion 140T and the compressor portion 140C, and also includes a bearing casing 141 for connecting the turbine portion 140T to the compressor portion 140C.

A bearing portion (chamber for accommodating a bearing member) 142 is provided in the bearing casing 141, and a turbine shaft 143 is rotatably supported by a bearing member (ceramic ball bearing) 142*a* of the bearing portion 142. A turbine blade 143T is fixed to a portion, on the turbine portion 140T side, of the turbine shaft 143, and a compressor blade 143C is fixed to a portion, on the compressor portion 140C side, of the turbine shaft 143.

Accordingly, the turbine shaft 143 is rotated in the course that exhaust gas from the above-described exhaust manifold 24 is discharged from an exhaust outlet T2 to the above-described exhaust pipe 27*a* (see FIGS. 1 and 2) via an exhaust passage T1 in the turbine portion 140T. As a result, the compressor blade 143C is rotated, so that air from an air intake port C1 communicated to an intake box (not shown) is press-fed from the above-described piping 26 (see FIG. 7) to the intercooler 23 via an intake passage C2 in the compressor portion 140C.

An oil inlet 144 is provided in an upper portion of the bearing casing 141. The oil inlet 144 communicates with the rear end portion 20*al* of the main gallery 20*a* via the above-described pipe 25*a* (see FIG. 7) functioning as an oil supply passage. The pipe 25*a* is connected to the oil inlet 144 via an orifice bolt 145.

An oil jacket 146 is formed in the bearing casing 141. The oil inlet 144 communicates with the oil jacket 146 via an oil passage 144*a*. The bearing portion 142 communicates with the oil inlet 144 via a narrow oil passage 144*b*.

Accordingly, the oil having entered from the oil inlet 144 is supplied to the oil jacket 146 via the oil passage 144*a*, to cool the bearing casing 141, the bearing portion 142, and the turbine shaft 143 and its neighborhood, and is also supplied to the bearing portion 142 via the oil passage 144*b*, to lubricate the bearing portion 142.

The oil supplied to the oil jacket 146 is recovered from oil outlets 146*a* and 146*b* of the oil jacket 146 via the above-described pipes 25*b* and 25*c* (see FIG. 6). The oil supplied to the bearing portion 142 once enters the oil jacket 146 via an outlet 142*b* of the bearing portion 142, and is then recovered from the outlets 146*a* and 146*b* of the oil jacket 146 to the oil pan 28 via the above-described pipes 25*b* and 25*c* (see FIG. 6).

The pipe 25*b* is connected to the oil outlet 146*a*, and the pipe 25*c* is connected to the oil outlet 146*b*. These oil outlets 146*a* and 146*b* are located at positions higher than an oil level O1 (see FIG. 6) at the time of stoppage of the engine.

A one-way valve 147 is interposed in each of the pipes 25*b* and 25*c* functioning as the oil return passages.

Referring to FIG. 10, a water jacket T3 is formed in a casing of the turbine portion 140T. A cooling water inlet T4 of the water jacket T3 is connected to the cooling water takeoff portion 30*a* (see FIG. 7) of the above-described jet pump 30 via a pipe 148*a* functioning as a supercharger cooling water passage provided independently from the other cooling water passages. A cooling water outlet (not shown) of the water jacket T3 is connected to the water jacket of the exhaust pipe 27*a* (see FIGS. 1 and 2) via a pipe 148*b* shown in FIG. 7.

Accordingly, cooling water from the jet pump 30 is supplied to the water jacket T3 of the turbo charger 140 directly not by way of another cooling object, to cool the turbo charger 140. The water is then used to cool the exhaust pipe 27*a*. In addition, the water used for cooling the exhaust pipe 27*a* flows in the water jacket of the anti-counterflow chamber 27*b* to cool the anti-couterflow chamber 27*b*, and is jetted in the water muffler 27*c* and is discharged via the exhaust/drainage pipe 27*d*, together with exhaust gas, in water stream generated by the jet pump 30.

The personal watercraft on which an engine with a supercharger is mounted, which is configured as described above, has the following functions and effects.

(a) The engine 20 for driving the jet propelling pump 30 is provided in the watercraft body 11 formed by the hull 14 and the deck 15 in such a manner as to extend in a length direction of the watercraft body 11, and the supercharger 140 is provided in a longitudinal direction of the engine 20, and the supercharger 140 and an end portion of the main gallery 20*a* of oil provided in parallel to the crankshaft 21 of the engine 20 are communicated to each other via the oil supply passage 25*a*. As a result, oil is supplied from the end portion of the main gallery 20*a* to the supercharger 140 directly via the oil supply passage 25*a*.

Accordingly, it is possible to shorten a time required to supply oil to the supercharger 140 after start of the engine, and thus ensure a speedy, positive operation of the supercharger 140.

Figure 13:
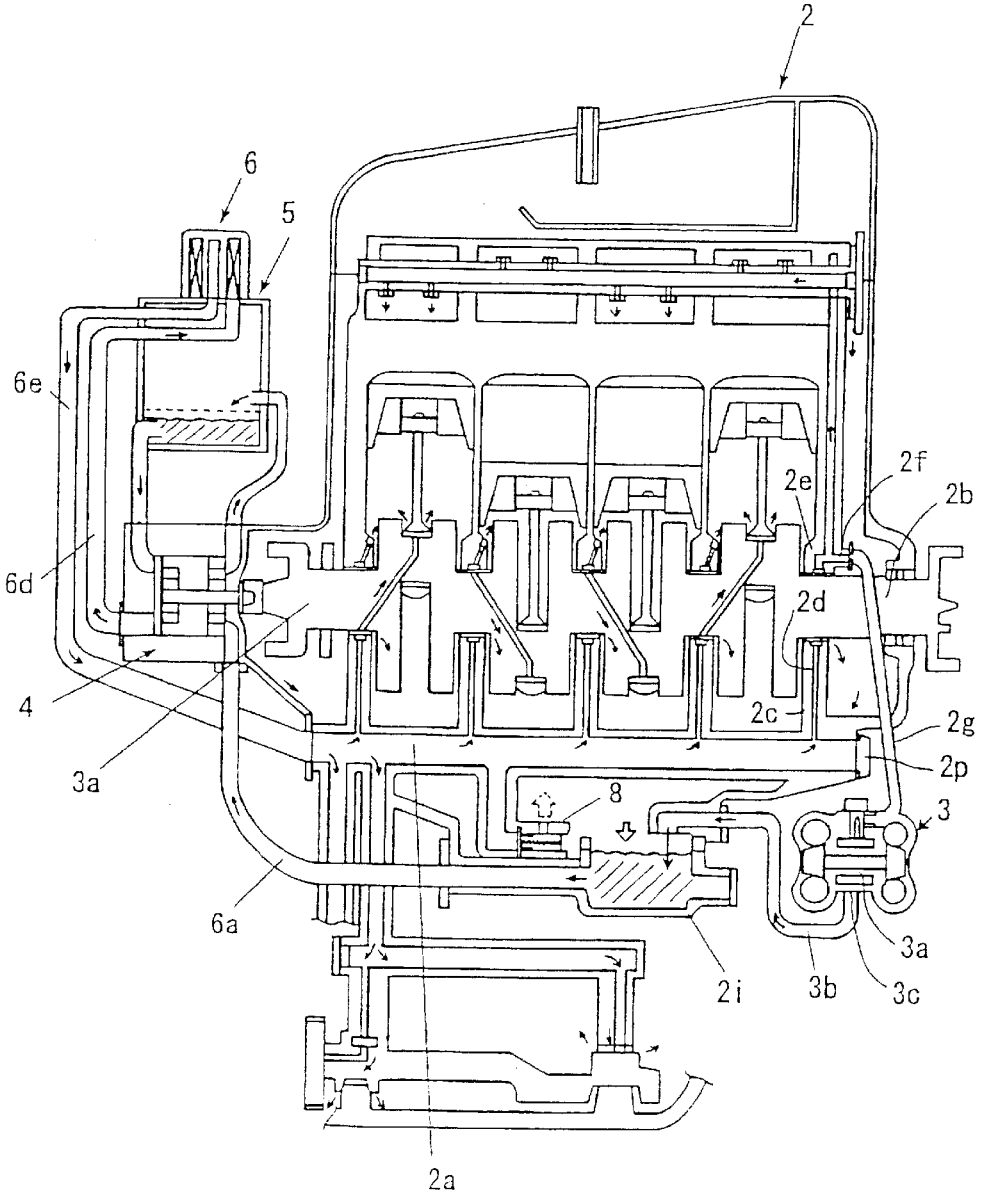
FIG. 13 PRIOR ART
FIG. 13 is a view illustrating the related art personal watercraft shown in FIG. 11.

In the related art, a plug is required to close one end portion of the main gallery (see reference numeral 2*p* in FIG. 13). By contrast, according to the personal watercraft on which an engine with a supercharger is mounted according to this embodiment, the plug can be eliminated.

(b) The oil pump 80 is provided on a portion, on the front side of the watercraft body 11, of the engine 20 and the supercharger 140 is provided on a portion, on the rear side of the watercraft body 11, of the engine 20, and the supercharger 140 and a rear end portion of the main gallery 20*a* communicate with each other via the oil supply passage 25*a*. As a result, it is possible to readily supply oil to the supercharger 140 disposed on the rear side of the engine.

(c) Oil supplied to the supercharger 140 is used for lubricating the bearing portion 142 of the supercharger 140, and also, oil is supplied to the oil jacket 146 formed in the bearing casing 141 for cooling the bearing casing 141. As a result, it is possible to use the oil supplied to the supercharger 140 not only for lubricating the bearing portion 142 of the supercharger 140, but also for cooling the bearing casing 141.

In the case of lubricating the bearing portion 142 of the supercharger 140 and cooling the bearing casing 141 by using the oil supplied to the supercharger 140, a large of oil must be readily supplied, as compared with the related art personal watercraft. However, according to the personal watercraft 10 on which an engine with a supercharger is mounted according to this embodiment, since oil is supplied from the end portion of the main gallery 20*a* to the supercharger 140 directly via the oil supply passage 25*a*, the required large amount of oil can be readily supplied.

(d) The oil outlets 146*a* and 146*b* in the supercharger 140 are disposed at positions higher than the oil level O1 at the time of stoppage of the engine. As a result, when the operation of the engine 20 is stopped (the operation of the oil pump 80 is stopped), oil in the supercharger 140 is readily discharged via the oil outlets 146*a* and 146*b*.

If oil remains in the supercharge 140 at a high temperature immediately after the engine 20 is stopped, then the remaining oil is likely to be carbonized. If this occurs, the entire oil circulating in the engine 20 is likely to deteriorate. However, according to the personal watercraft 10 of the present invention, in which an engine with a supercharger is mounted, since oil in the supercharger 140 is readily discharged via the oil outlets 146*a* and 146*b* when the engine 20 is stopped, the amount of oil remaining in the supercharger 140 after the engine 20 is stopped is made as small as possible. This reduces the deterioration of the entire oil circulating in the engine 20.

(e) The engine 20 is a dry sump engine, and the oil tank 50 is provided on an extension of the crankshaft of the engine 20. As a result, it is possible to lower the oil level O1 at the time of stoppage of the engine.

Accordingly, it is possible to more readily discharge oil in the supercharger 140 from the oil outlets 146*a* and 146*b*, and thus more effectively reduce the deterioration of the entire oil circulating in the engine 20.

(f) The one-way valve 147 is interposed in the oil return passages 25*b* and 25*c* communicated to the oil outlets 146*a* and 146*b* in the supercharger 140. As a result, it is possible to eliminate the problem, that when the personal watercraft 10 is turned over, oil counter flows, and remains in the supercharger 140 at a high temperature.

Accordingly, the carbonization of oil is more likely to be prevented. Hence, the deterioration of the entire oil circulating in the engine 20 can be reduced.

(g) In the personal watercraft on which an engine with a supercharger is mounted, cooling water from the pump 30 is supplied to the supercharger 140 via the supercharger cooling water passage 148*a* provided independently from the other cooling water passages. As a result, it is possible to efficiently, sufficiently cool the supercharger 140.

(h) The cooling water from the supercharger cooling water passage 148*a* is first supplied to the supercharger 140 to cool the supercharger 140, and the cooling water is then supplied to the exhaust system (exhaust pipe 27*a*, anti-counterflow chamber 27*b*, water muffler 27*c*, and exhaust/drainage pipe 27*d*) provided on the downstream from the supercharger 140 via the exhaust system of the engine 20. As a result, the cooling water used to cool the supercharger 140 is kept at the lowest possible temperature.

Thus, cooling of the supercharger 140 is accomplished efficiently and sufficiently. Further, the exhaust system disposed on the downstream side from the supercharger 140 can be cooled also.

(k) The cooling water, which has been used for cooling the supercharger 140, is supplied to the exhaust pipe 27*a* provided on the downstream side from the supercharger 140 in the exhaust system, and is then discharged, together with exhaust gas, outwardly from the watercraft 10. As a result, it is possible to further cool the exhaust gas, which has been used for driving the supercharger 140, in the exhaust pipe 27*a*.

To be more specific, since an exhaust gas is synergistically reduced by cooling the exhaust gas in the supercharger 140 and the exhaust pipe 27*a*, it is possible to reduce exhaust noise.

(l) Since the oil supplied to the supercharger 140 is used for lubricating the bearing portion 142 of the supercharger 140 and further the oil is supplied to the oil jacket 146 formed in the bearing casing 141 to cool the bearing casing 141, it is possible to more desirably cool the supercharger 140.

(m) The hull 14 and the deck 15 of the personal watercraft are water-tightly formed and the opening portion 15*a* of the deck 15 is closed with the lid member (seat) 12 to form the space 16 in the watercraft body. The intake ducts 18 and 19 for introducing atmospheric air outside the watercraft body are provided in the space 16, and the engine 20 and the turbo charger 140 connected to the exhaust manifold 24 of the engine 20 are provided in the space 16. The turbo charger 140 is located at a position higher than those of the openings 18*a* and 19*a* of the intake ducts 18 and 19. As a result, in the case of introducing atmospheric air outside the watercraft body in the space 16 via the intake ducts 18 and 19 during running of the personal watercraft, even if water (in the form of splash) permeating the space 16, it is possible to reduce the likelihood that water will be directly splashed to the turbo charger 140.

Accordingly, it is possible to reduce the likelihood that the casing and the like of the turbo charger 140 kept at a high temperature is rapidly and partially cooled to thereby cause thermal fatigue of the turbo charger 140. This feature improves the durability of the turbo charger 140.

(n) In the turbo charger 140, the water jacket T3 is formed in the casing of the turbine portion 140T and the oil jacket 146 is formed in the bearing casing 141, wherein cooling water is supplied to the water jacket T3 and cooling oil is supplied to the oil jacket 146. As a result, it is possible to prevent the turbo charger 140 from being excessively heated at a high temperature.

Accordingly, even when atmospheric air is introduced from outside the watercraft body into the space 16 via the intake ducts 18 and 19 during running of the personal watercraft, and water (in the form of splash) permeating the space 16 directly reaches the turbo charger 140, it is possible to reduce temperature change in the casing of the turbo charger 140.

As a result, it is possible to reduce the likelihood that there occurs thermal fatigue of the turbo charger 140, and hence to certainly improve the durability of the turbo charger 140.

(o) Since cooling water is supplied to the water jacket T3 via the turbo charger cooling water passage 148*a* provided independently from the other cooling water passages, it is possible to efficiently cool the turbo charge 140.

Accordingly, even atmospheric air is introduced from outside the watercraft body into the space 16 via the intake ducts 18 and 19 during running of the personal watercraft, and water (in the form of splash) permeating the space 16 directly reaches the turbo charger 140, it is possible to further reduce temperature change in the casing of the turbo charger 140.

As a result, it is possible to further reduce the likelihood that thermal fatigue of the turbo charger 140 will occur, and hence to more certainly improve the durability of the turbo charger 140.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft on which an engine with a supercharger is mounted, comprising:

an engine for driving a jet propelling pump provided in a watercraft body formed by a hull and a deck in such a manner as to extend in a length direction of said watercraft body;

a supercharger provided in a longitudinal direction of said engine; and an oil supply passage for communicating between said supercharger and an end portion of a main gallery of oil provided in parallel to a crankshaft of said engine.

2. The personal watercraft on which an engine with a supercharger is mounted according to claim 1, wherein said oil supply passage runs substantially upward from said end portion of said main gallery to said supercharger.

3. The personal watercraft on which an engine with a supercharger is mounted according to claim 1, further comprising:

an oil pump provided on a portion of said engine, on a front side of said watercraft body, and said supercharger being provided on a portion of said engine, on a rear side of said watercraft body, and said supercharger and a rear end portion of said main gallery communicate with each other via said oil supply passage.

4. The personal watercraft on which an engine with a supercharger is mounted according to claim 1, wherein said oil supply passage is connected to an oil inlet of said supercharger via an orifice bolt.

5. The personal watercraft on which an engine with a supercharger is mounted according to claim 4, wherein said oil inlet is disposed between a compressor portion and a turbine portion of said supercharger.

6. The personal watercraft on which an engine with a supercharger is mounted according to claim 3, wherein said oil supply passage runs substantially upward from said end portion of said main gallery to said supercharger.

7. The personal watercraft on which an engine with a supercharger is mounted according to claim 1, wherein oil supplied to said supercharger is used for lubricating a bearing portion of said supercharger, and also the oil is supplied to an oil jacket formed in a bearing casing to cool said bearing casing.

8. The personal watercraft on which an engine with a supercharger is mounted according to claim 1, further comprising an oil outlet in said supercharger disposed at a position higher than an oil level when said engine is stopped.

9. The personal watercraft on which an engine with a supercharger is mounted according to claim 8, wherein said engine is a dry sump engine, and an oil tank is provided on an extension of a crankshaft of said engine.

10. The personal watercraft on which an engine with a supercharger is mounted according to claim 9, wherein said oil tank is provided at a front of said engine.

11. The personal watercraft on which an engine with a supercharger is mounted according to claim 9, wherein a one-way valve is interposed in an oil return passage which communicates with said oil outlet in said supercharger.

12. A personal watercraft on which an engine with a supercharger is mounted, comprising:

an engine for driving a jet propelling pump provided in a watercraft body formed by a hull and a deck in such a manner as to extend in a length direction of said watercraft body;

a supercharger provided in a longitudinal direction of said engine; and an oil supply passage running substantially upward from an end portion of a main gallery of oil provided in parallel to a crankshaft to said supercharger for providing a supply of oil directly from said main gallery to said supercharger.

13. The personal watercraft on which an engine with a supercharger is mounted according to claim 12, further comprising:

an oil pump provided on a portion of said engine, on a front side of said watercraft body, and said supercharger being provided on a portion of said engine, on a rear side of said watercraft body, and said supercharger and a rear end portion of said main gallery communicate with each other via said oil supply passage.

14. The personal watercraft on which an engine with a supercharger is mounted according to claim 12, wherein said oil supply passage is connected to an oil inlet of said supercharger via an orifice bolt.

15. The personal watercraft on which an engine with a supercharger is mounted according to claim 14, wherein said oil inlet is disposed between a compressor portion and a turbine portion of said supercharger.

16. The personal watercraft on which an engine with a supercharger is mounted according to claim 12, wherein oil supplied to said supercharger is used for lubricating a bearing portion of said supercharger, and also the oil is supplied to an oil jacket formed in a bearing casing to cool said bearing casing.

17. The personal watercraft on which an engine with a supercharger is mounted according to claim 12, further comprising an oil outlet in said supercharger disposed at a position higher than an oil level when said engine is stopped.

18. The personal watercraft on which an engine with a supercharger is mounted according to claim 17, wherein said engine is a dry sump engine, and an oil tank is provided on an extension of a crankshaft of said engine.

19. The personal watercraft on which an engine with a supercharger is mounted according to claim 18, wherein said oil tank is provided at a front of said engine.

20. The personal watercraft on which an engine with a supercharger is mounted according to claim 19, wherein a one-way valve is interposed in an oil return passage which communicates with said oil outlet in said supercharger.

* * * * *